US005930838A

United States Patent [19]

Carter-Scott-Pomije

[11] Patent Number: 5,930,838

[45] **Date of Patent: *Aug. 3, 1999**

[54] PANT GARMENT HAVING AN OPENING OPTIMIZED FOR THE FEMALE ANATOMY

[76] Inventor: Cherie Carter-Scott-Pomije, 145 Canon Dr., Santa Barbara, Calif. 93105

[ * ] Notice: This patent issued on a continued prosecution application filed under 37 CFR 1.53(d), and is subject to the twenty year patent term provisions of 35 U.S.C. 154(a)(2).

[21] Appl. No.: 08/844,998

[22] Filed: Apr. 23, 1997

Related U.S. Application Data

[63] Continuation of application No. 08/395,366, Feb. 21, 1995, abandoned.

[51] Int. Cl.[6] ..... A41D 1/06; A41D 27/00

[52] U.S. Cl. ..... 2/79; 2/78.2; 2/227; 2/408

[58] Field of Search ..... 2/400, 401, 402, 2/403, 406, 408, 79, 78.2, 227, 919, 920, 75, 80, 83, 69, 69.5, 228, 229, 230, 231–238; 450/102, 103, 104, 105

[56] References Cited

U.S. PATENT DOCUMENTS

| | | | |
|---|---|---|---|
| D. 324,125 | 2/1992 | Gambier | D2/4 |
| 1,083,712 | 1/1914 | Uyeda | 2/408 |
| 1,426,525 | 8/1922 | Walsh | 2/408 |
| 2,016,990 | 10/1935 | Davis | 2/408 |
| 2,277,068 | 3/1942 | Bulloch | 2/408 |
| 2,396,599 | 3/1946 | O'Brien | 2/408 |
| 2,476,585 | 7/1949 | Cohen | 2/408 |
| 2,477,593 | 8/1949 | Gershenow | 2/408 |
| 2,896,633 | 7/1959 | McKee | 450/102 |
| 3,279,469 | 10/1966 | Schustack | 128/526 |
| 3,398,739 | 8/1968 | Marino | 128/529 |
| 3,974,836 | 8/1976 | Carlson | 128/526 |
| 4,301,550 | 11/1981 | Carver | 2/408 |
| 4,597,110 | 7/1986 | Smith, Sr. | 2/408 |
| 4,637,078 | 1/1987 | Southwell | 2/408 |
| 4,835,795 | 6/1989 | Lonon | 2/408 |
| 4,951,321 | 8/1990 | Mortensen et al. | 2/408 |
| 4,961,234 | 10/1990 | Liebman | 2/408 |
| 5,241,710 | 9/1993 | Lockhart | 450/103 |
| 5,341,515 | 8/1994 | Cohen | 2/400 |
| 5,435,014 | 7/1995 | Moretz et al. | 2/406 |

FOREIGN PATENT DOCUMENTS

| | | | |
|---|---|---|---|
| 1363957 | 5/1964 | France | 2/227 |

OTHER PUBLICATIONS

Gershman, Maurice, "Self Adhering Nylon Tapes." The J.A.M.A., vol. 168, No. 7, p. 930, Oct. 1958.

*Primary Examiner*—Jeanette Chapman
*Attorney, Agent, or Firm*—Skjerven, Morrill, MacPherson, Franklin & Friel LLP; Ken J. Koestner

[57] ABSTRACT

A pant or short garment has a female body crotch opening in the crotch region of the garment. The crotch opening is covered by a removable saddle flap which is firmly affixed to the seat of the garment and is attachable at the inner left and right leg region and a frontal crotch region of the garment by a closure such as a Velcro™ closure. Thus, in place of the traditional frontal, fly-type opening for a pant garment, the illustrative garment provides easy access for the female anatomy.

14 Claims, 4 Drawing Sheets

PANT GARMENT HAVING AN OPENING OPTIMIZED FOR THE FEMALE ANATOMY

This application is a continuation of application Ser. No. 08/395,366, filed Feb. 21. 1995, now abandoned.

BACKGROUND OF THE INVENTION

1. Field of the Invention

The present invention relates to a pant or short garment for covering the lower body, and in particular to a pant or short garment having a female body crotch opening and saddle flap which covers the opening.

2. Discussion of the Related Art

Traditional pant garments typically use a fly-type front opening and closing scheme which is more appropriate for the male anatomy than for the female anatomy. A male wearing the traditional pant garment can relieve body fluids simply and efficiently by simply opening the fly-type aperture. In contrast, a female wearing the traditional pant garment must partially disrobe. A result of this difference in efficiency is readily apparent from the long lines that often form at female public toilets. Often the act of relieving oneself becomes so onerous that women endure the discomfort of a full bladder until more convenient accommodations are available. Unfortunately, this personal discomfort is not the only drawback to enduring of a full bladder. In addition, the discomfort is accompanied by the risk of developing bladder infection which occasionally leads to serious medical difficulties. This is sometimes difficult and often dangerous. Accordingly, there is a need for a better design of female garments to furnish improved access and convenience.

SUMMARY OF THE INVENTION

In accordance with the present invention, a garment has a female body crotch opening in the crotch region of the garment. The crotch opening is covered by a removable saddle flap which is firmly affixed to the seat of the garment and is attachable at the inner left and right leg region and a frontal crotch region of the garment by a closure such as a VELCRO™ closure.

In accordance with a first aspect of the present invention, a garment includes a pull-on pant having a female body crotch opening, a saddle flap affixed to the pant adjacent to an edge of the crotch opening and removably covering the crotch opening, and a closure for removably attaching the saddle flap to additional edges of the crotch opening. The saddle flap is affixed to the pant at an edge of the crotch opening and is removably attached to the pant at other edges using a grab and rip mechanism, such as VELCRO™ for easy access and efficient removal of the flap.

In accordance with the present invention, in place of the traditional frontal, fly-type opening for a pant garment, the present invention provides easy access for the female anatomy.

This invention will be more fully understood in light of the following detailed description taken together with the drawings.

BRIEF DESCRIPTION OF THE DRAWINGS

FIG. 1(*b*) shows a rear view of the external short garment with a female body crotch opening and saddle flap.

FIG. 7(*b*) illustrates a pattern for a rear panel of the garment.

DETAILED DESCRIPTION OF THE DRAWINGS

Figure 1A:
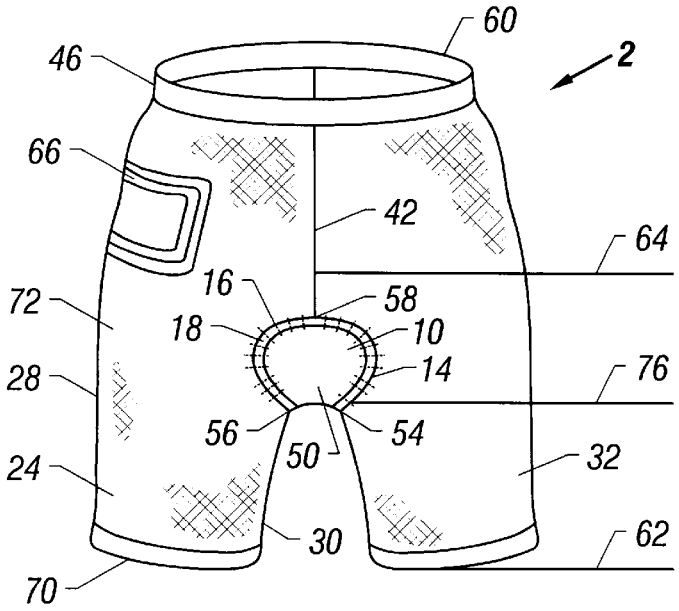
FIG. 1(*a*) illustrates a frontal view of an external short garment having a female body crotch opening and saddle flap.
Figure 1B:
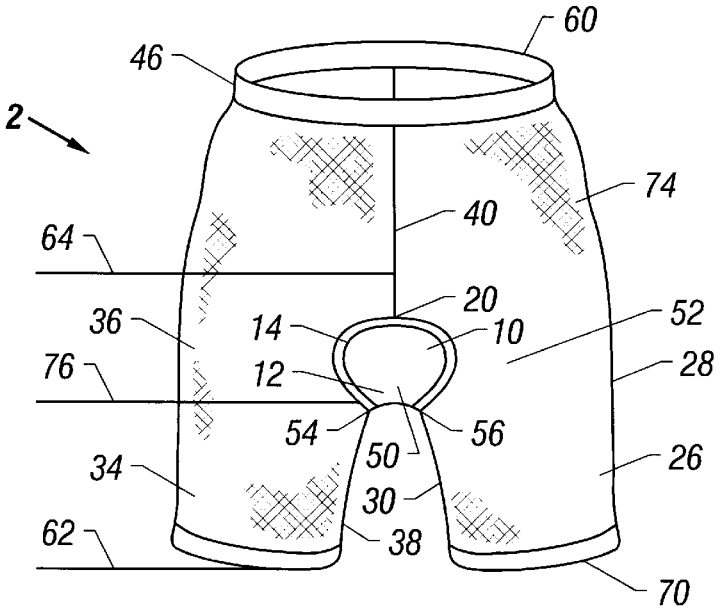
Figure 2:
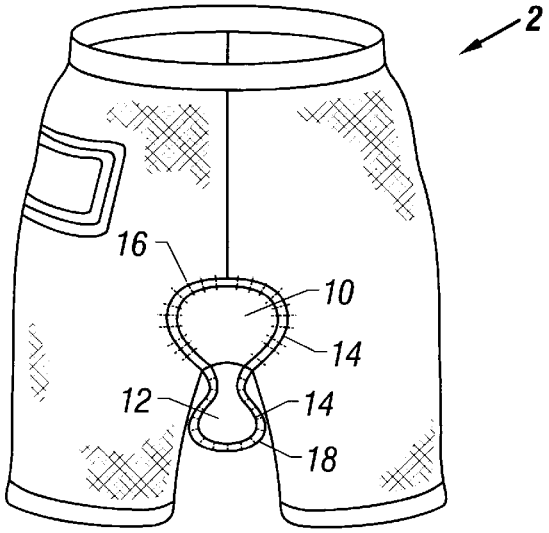
FIG. 2 shows a frontal view of the garment with the saddle flap unattached.

FIGS. 1(*a*) and 1(*b*) illustrate respective frontal and rear views of an external garment 2 for the lower part of a female body. The garment 2 is here shown in a short length for convenience but which may have a full-pant length in other embodiments. The garment 2 is a pull-on type pant or short, as distinguished from a fly-front garment. The garment 2 has a female body crotch opening 10 in a crotch region 50 and a saddle flap 12, also called a crotch flap, which is affixed to a seat 20 at a seat region 52 and is attachable at an inner left leg region 54, an inner right leg region 56 and a frontal crotch region 58 by a closure 14. The opening 10 is shown here in a closed state. The crotch opening 10 extends from the crotch region 50 at the crotchline 76 forward and upward to the front 72 of the garment 2 approximately to the level of the hipline 64 at the fullest part of the wearer's body as viewed from the side. The crotch opening 10 extends from the crotch region 50 at the crotchline 76 rearward and upward to the rear 74 of the garment 2 also approximately to the level of the hipline 64. The closure 14 is preferably a VELCRO™ closure using an inner leg VELCRO™ strip 16 and a matching saddle closure VELCRO™ fastener strip 18 which is more easily seen in FIG. 3, so that the saddle flap 12 utilizes a "grab and rip" technique for quickly and efficiently opening the saddle flap 12. The inner leg VELCRO™ fastener strip 16 is seen more easily in FIGS. 2, 5 and 6. FIG. 2 shows a frontal view of the garment 2 with the saddle flap 12 unattached. The efficient grab and rip closure 14 enables the wearer to quickly and efficiently relieve bodily functions, most particularly the kidney function, without having to disrobe or to expose oneself. Referring again to FIGS. 1(*a*) and 1(*b*), the garment 2 is worn on the portion of the body essentially from a waist 60 corresponding to the natural waistline of the wearer's body, and extending below the waist to a hemline 62 at the bottom 70 of the garment 2, shown here at a level above the knee. Other embodiments of the garment have different lengths, such as a pant length extending essentially to a heel, ankle or other length.

Figure 3:
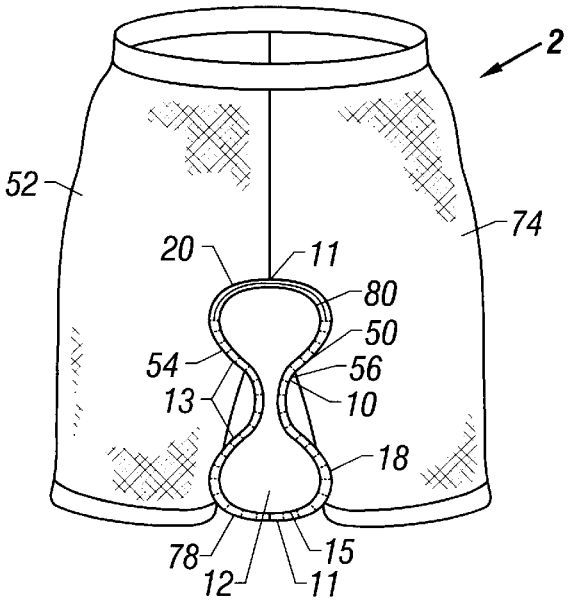
FIG. 3 illustrates a rear view of the garment with the saddle flap unattached and the crotch opening exposed.
Figure 4:
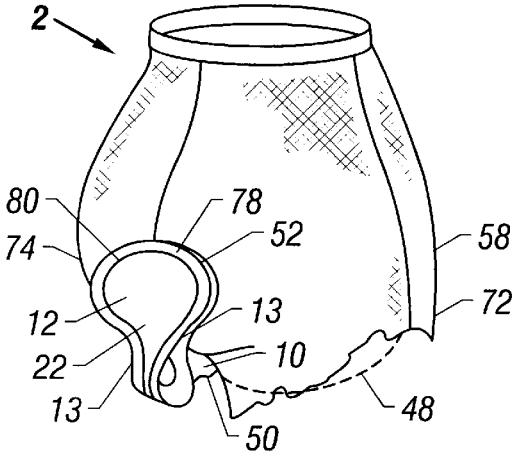
FIG. 4 shows a rear view of the garment with the saddle flap unattached and held up with the saddle flap front portion folded over the rear portion.

Referring to FIGS. 3 and 4, the saddle flap 12 has a frontal, rounded "spoon" portion 15 and is gusseted so that, when the saddle flap 12 is closed, the saddle flap 12 has the form of two point-intersecting generally-isosceles triangles having bases 11 at the front 72 and rear 74 of the crotch opening 10 and sides 13 extending respectively rearward and forward toward the crotch region 50. FIG. 3 illustrates a rear view of the garment 2 with the saddle flap 12 unattached and the crotch opening 10 exposed. FIG. 4 shows a rear view of the garment 2 with the saddle flap 12 unattached and held up with the saddle flap 12 front portion 78 folded over the rear portion 80. In some embodiments, the saddle flap 12 is affixed at the seat region 52 by sewing. In alternative embodiments, the saddle flap 12 is glued, heat bonded or otherwise affixed to the seat 20. In further alternative embodiments, the saddle flap 12 is formed from material extending from the seat 20. In the illustrative embodiment of the short garment, the saddle flap 12 is lined with a thin plastic layer 22 to guard against accidental vaginal discharge or secretions. Some alternative embodiments do not utilize the thin plastic liner layer 22. The closure 14 at the inner left leg region 54, the inner right leg region 56 and the frontal crotch region 58 closes the saddle flap 12 in the crotch region 50 so that the saddle flap 12 fits the wearer high enough to prevent sagging but sufficiently low so that movement is comfortable. Thus, the saddle flap 12 conforms to the crotch curve 48 from the front 72 to the rear 74 of the garment 2, curving at the front 72 and back 74 and straight in between, and covers the crotch area 50 of the wearers body without pulling.

Referring again to FIGS. 1(*a*) and 1(*b*), garment 2 includes a right front leg panel 24 and a right rear leg panel 26 affixed at a right side seam 28 from the waist 60 to the hemline 62 and affixed at a right inseam 30 from the crotch opening 10 at the inner right leg region 56 to the hemline 62. Garment 2 also includes a left front leg panel 32 and a left rear leg panel 34 affixed at a left side seam 36 from the waist 60 to the hemline 62 and affixed at a left inseam 38 from the crotch opening 10 at the inner left leg region 54 to the hemline 62. The right and left side seams 28 and 36 are substantially straight and hang perpendicular to the floor, visually bisecting the body of the wearer at the sides. The right rear leg panel 26 is affixed to the left rear leg panel 34 at a rear seam 40 which extends from the waist 60 to the crotch opening 10 at the seat region 52. The right front leg panel 24 is affixed to the left front leg panel 32 at a frontal seam 42 which extends from the waist 60 to the crotch opening 10 at the frontal crotch region 58. When the wearer is wearing the garment 2, the frontal seam 42 is positioned corresponding to the angle of the body from the waist 60 to the hipline 64. The frontal seam 42 is substantially straight in this area. In some embodiments, the seams 28, 30, 36, 38, 40 and 42 are flat-locked seams for the comfort of the wearer.

Figure 5:
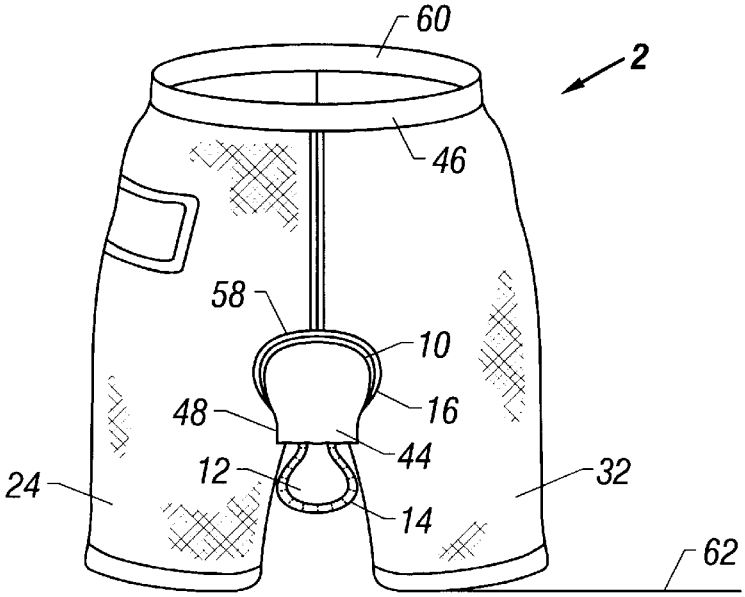
FIG. 5 shows a frontal view of the garment with a modesty shield extended.
Figure 6:
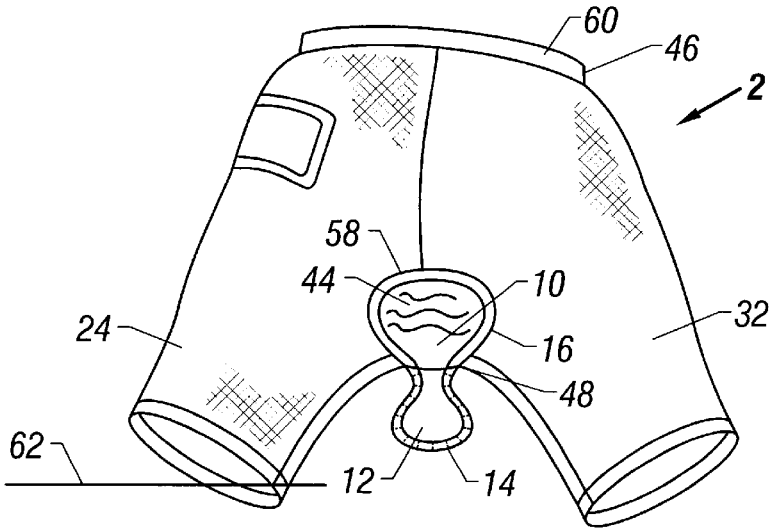
FIG. 6 illustrates a rear view of the garment with the modesty shield retracted and tucked.

Referring to FIGS. 5 and 6, the garment 2 also includes a modesty shield 44 which is affixed, for example by sewing to the right front leg panel 24 and left front leg panel 32 adjacent to the crotch opening 10 at the frontal crotch region 58. The modesty shield 44 drops downward generally to the level of the crotch curve 48, toward the hemline 62, as the saddle flap 12 closure 14 is detached for privacy purposes. FIG. 5 shows the modesty shield 44 extended and FIG. 6 shows the modesty shield 44 retracted and tucked. In some embodiments, the modesty shield 44 is constructed from a thin plastic sheet. In other embodiments, the modesty shield 44 is constructed from a thin fabric sheet, with a thin, protective plastic lining affixed to the body surface of the thin fabric shield.

Referring again to FIGS. 1(*a*) and 1(*b*), at the waist 60 of the garment 2, a waistband 46 is affixed by sewing or other bonding. The waist 60 and waistband 46 of the garment 2 extend parallel to the floor when the wearer is standing or sitting. Some embodiments of the garment 2 do not utilize a waistband 46 and some embodiments include an elastic waist.

The garment 2 is also shown with a rectangular pocket 66 affixed to the right front leg panel 24. The rectangular pocket 66 is useful for holding tissue paper, for example. In alternative embodiments, a slant pocket, a side-seam pocket or the like are affixed.

Various embodiments of the garment 2 are constructed from various suitable materials. For example, female exercise, biking and skiing apparel may utilize a soft and stretchy cotton/Lycra™ blend for support and fit considerations.

Figure 7B:
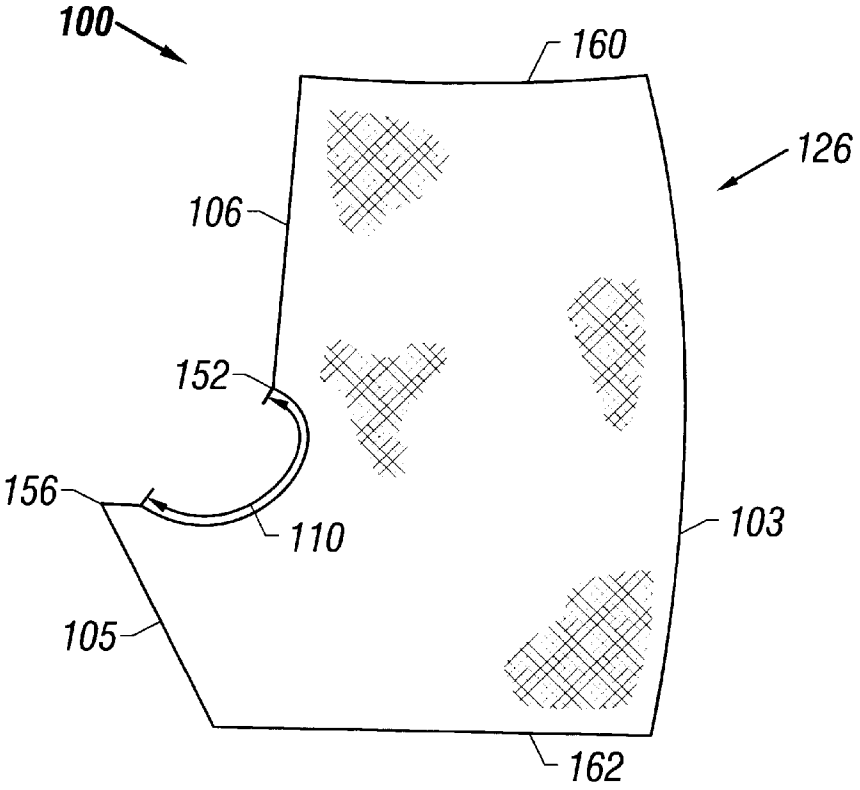
FIG. 7(*a*) depicts a pattern for a front panel of the garment.
Figure 7A:
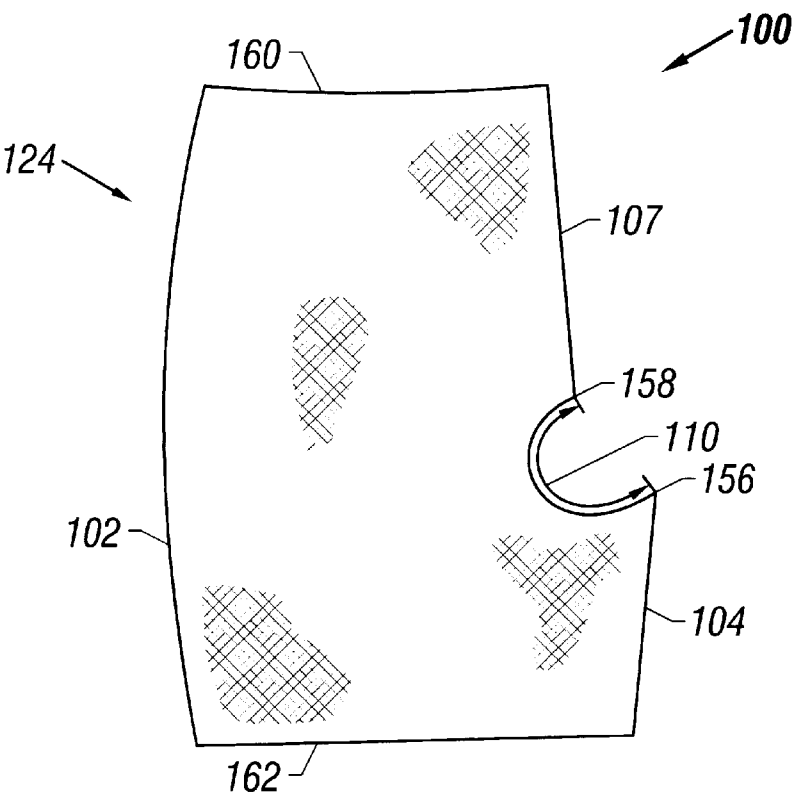

FIGS. 7(*a*) and 7(*b*) respectively illustrate patterns for a front leg panel 124 and a rear leg panel 126 of a garment 100. The front leg panel 124 corresponds to the right and left front leg panels 24 and 32 and the rear leg panel 126 corresponds to the right and left rear leg panels 26 and 34 shown in FIGS. 1(*a*) and 1(*b*). The garment 100 is constructed from the panels by affixing a side edge 102 of the front leg panel 124 to a side edge 103 of the rear leg panel 126 at a side seam (not shown) from a waist 160 to a hemline 162 to form a first pair of panels (not shown). Furthermore, an inseam edge 104 of the front leg panel 124 is affixed to an inseam edge 105 of the rear leg panel 126 at an inseam (not shown) from a crotch opening 110 at the inner leg region 156 to the hemline 162. The front and rear leg panels 124 and 126 are mutually balanced having fabric evenly distributed around the legs.

A second pair of front and rear leg panels (not shown), which are identical to panels 124 and 126, are attached to form a mirror image of the first pair of panels. The first pair of panels is affixed to the second pair of panels (not shown) by affixing the respective rear leg panels at a rear edge 106 from the waist 160 to the crotch opening 110 at a seat region 152 and affixing the respective front leg panels at a front edge 107 from the waist 160 to the crotch opening 110 at a frontal crotch region 158.

While the invention has been described with respect to certain embodiments, the scope of the present invention is defined by the appended claims and is not limited to the embodiments described herein, which are merely illustrative. Accordingly, other embodiments not described herein may be within the scope of the invention as defined by the appended claims.

What is claimed is:

1. An outergarment comprising:

a pull-on outergarment pant having a female body crotch opening with peripheral edges;

a crotch flap fixedly attached to the peripheral edges of a first portion of the crotch opening by stitching and removably attached to a second portion opposing the first portion of the crotch opening by a releasable attachment so that the crotch flap is partially removable from the outergarment;

a closure for removably attaching the crotch flap to the peripheral edges of the crotch opening, the enclosure being a self-adhering strip closure including:

an inner leg synthetic strip; and a matching crotch closure synthetic strip, one of the synthetic strips having a bristle surface and the other of the synthetic strips having a matted pile surface so that the synthetic strips are self-adhering; and a modesty shield affixed to the outergarment adjacent to an upper frontal edge of the crotch opening at the frontal crotch region of the outergarment and dropping downward approximately to the level of a crotch curve when the crotch flap is opened, wherein the modesty shield is constructed from a thin plastic sheet.

2. An outergarment according to claim 1, wherein the pull-on outergarment is a one-piece pull-on outergarment.

3. An outergarment according to claim 1 wherein the crotch opening extends:

from a crotch region at a crotchline forward and upward to a front of the outergarment approximately to the level of a hipline; and from the crotch region at the crotchline rearward and upward to a rear of the outergarment approximately to the level of the hipline.

4. An outergarment according to claim 1 wherein:

the outergarment has a rear seat region, a frontal crotch region, an inner right leg region, an inner left leg region; and the crotch flap is affixed to the outergarment along the edge of the crotch opening adjacent to the seat region; and the closure is removably attached to the outergarment long the edges of the crotch opening adjacent to the inner right leg region, the frontal crotch region and the inner left leg region.

5. An outergarment according to claim 1 wherein the crotch flap has a frontal, rounded spoon portion.

6. An outergarment according to claim 1 wherein the crotch flap is lined with a thin plastic layer.

7. An outergarment according to claim 1, wherein the outergarment is a short-length outergarment.

8. An outergarment comprising:

a pull-on outergarment having a female body crotch opening with peripheral edges, the pull-on outergarment including:

a right front leg panel;

a right rear leg panel affixed to the right front leg panel at a right side seam extending from a waist to a hemline and affixed to the right front leg panel at a right inseam extending from a crotch opening at an inner right leg region to the hemline;

a left front leg panel affixed to the right front leg panel at a frontal seam extending from the waist to the crotch opening at a frontal crotch region;

a left rear leg panel affixed to the left front leg panel at a left side seam extending from the waist to the hemline and affixed to the left front leg panel at a left inseam extending from the crotch opening at an inner left leg region to the hemline, the left rear leg panel being affixed to right rear leg panel at a rear seam extending from the waist to the crotch opening at a seat region;

a crotch flap fixedly attached to the peripheral edges of a first portion of the crotch opening by stitching and removably attached to a second portion opposing the first portion of the crotch opening by a releasable attachment so that the crotch flap is partially removable from the outergarment; and a closure for removably attaching the crotch flap to the peripheral edges of the crotch opening, the closure being a self-adhering strip including: an inner leg synthetic strip; and a matching crotch closure synthetic strip, one of the synthetic strips having a bristle surface and the other of the synthetic strips having a matted pile surface so that the synthetic strips are self-adhering; and a modesty shield affixed to the outergarment adjacent to an upper frontal edge of the crotch opening at the frontal crotch region of the outergarment and dropping downward approximately to the level of a crotch curve when the crotch flap is opened, wherein the modesty shield is constructed from a thin plastic sheet.

9. An outergarment according to claim 8, wherein the pull-on outergarment is a one-piece pull-on outergarment.

10. An outergarment according to claim 8 wherein the crotch opening extends:

from a crotch region at a crotchline forward and upward to a front of the outergarment approximately to the level of a hipline; and from the crotch region at the crotchline rearward and upward to a rear of the outergarment approximately to the level of the hipline.

11. An outergarment according to claim 8 wherein:

the outergarment has a rear seat region, the frontal crotch region, an inner right leg region, an inner left leg region; and the crotch flap is affixed to the outergarment along the edge of the crotch opening adjacent to the seat region; and the closure is removably attached to the outergarment long the edges of the crotch opening adjacent to the inner right leg region, the frontal crotch region and the inner left leg region.

12. An outergarment according to claim 8 wherein the crotch flap has a frontal, rounded spoon portion.

13. An outergarment according to claim 8 wherein the crotch flap is lined with a tin plastic layer.

14. An outergarment according to claim 8, wherein the outergarment is a short-length outergarment.

* * * * *